US010863869B2

(12) United States Patent
Tran et al.

(10) Patent No.: US 10,863,869 B2
(45) Date of Patent: Dec. 15, 2020

(54) FOOT SPA

(71) Applicant: GULFSTREAM INC., Cambridge (CA)

(72) Inventors: Minh Sang Tran, Cambridge (CA); Chris Alexander, Cambridge (CA)

(73) Assignee: GULFSTREAM INC., Cambridge (CA)

( * ) Notice: Subject to any disclaimer, the term of this patent is extended or adjusted under 35 U.S.C. 154(b) by 0 days.

(21) Appl. No.: 16/213,573

(22) Filed: Dec. 7, 2018

(65) Prior Publication Data

US 2019/0104891 A1 Apr. 11, 2019

Related U.S. Application Data

(63) Continuation-in-part of application No. PCT/CA2018/051010, filed on Aug. 22, 2018, and a continuation-in-part of application No. 15/829,178, filed on Dec. 1, 2017, now Pat. No. 10,512,589.

(60) Provisional application No. 62/429,116, filed on Dec. 2, 2016.

(51) Int. Cl.

| | |
|---|---|
| ***A47K 3/00*** | (2006.01) |
| ***A47K 3/022*** | (2006.01) |
| ***A61H 35/00*** | (2006.01) |
| ***A61H 33/02*** | (2006.01) |
| ***A61H 33/00*** | (2006.01) |
| *A61H 33/14* | (2006.01) |

(52) U.S. Cl.

CPC ..... *A47K 3/001* (2013.01); *A47K 3/022* (2013.01); *A61H 33/005* (2013.01); *A61H 33/02* (2013.01); *A61H 33/028* (2013.01); *A61H 35/006* (2013.01); *A61H 2033/141* (2013.01); *A61H 2201/0228* (2013.01); *A61H 2201/1207* (2013.01); *A61H 2201/164* (2013.01); *A61H 2201/1688* (2013.01); *A61H 2201/50* (2013.01); *A61H 2205/12* (2013.01)

(58) Field of Classification Search

CPC ..... A47K 3/001
USPC ..... 4/622
See application file for complete search history.

(56) References Cited

U.S. PATENT DOCUMENTS

| | | | |
|---|---|---|---|
| 2,719,307 | A | 10/1955 | Reid |
| 2009/0089924 | A1 | 4/2009 | Jan |

*Primary Examiner* — Lauren A Crane
(74) *Attorney, Agent, or Firm* — Blue Filament Law PLLC

(57) ABSTRACT

Disclosed is a disposable for use with a surface that defines a basin for receiving liquid. The disposable has a pair of surfaces spaced apart from one another by a tubular sidewall. One of the pair of surfaces is positioned, in use, against the basin-defining surface. In use, gas issues through the sidewall in the form of bubbles. The disposable is useful in association with foot spas and the like. A mechanism for puncturing a liner is also disclosed.

16 Claims, 18 Drawing Sheets

62
60
64

39A
39B
39

FOOT SPA

RELATED APPLICATIONS

This application is a continuation-in-part of U.S. Utility application Ser. No. 15/829,178 filed Dec. 1, 2017 that in turn claims priority benefit to U.S. Provisional Ser. No. 62/429,116 filed Dec. 2, 2016; and a continuation-in-part of PCT Application Ser. No. PCT/CA2018/051010, filed Aug. 22, 2018; which in turn claims priority benefit to U.S. Provisional Ser. No. 62/738,661 filed Sep. 28, 2018; and U.S. Provisional Ser. No. 62/767,153 filed Nov. 14, 2018; the contents of which are hereby incorporated by reference.

FIELD OF THE INVENTION

The invention relates to the field of skin care.

BACKGROUND OF THE INVENTION

In the field of aesthetics, it is well known to produce pedicure systems including basins which contain heated, roiling water. Known systems are relatively costly to manufacture, relatively hard to clean and relatively prone to breakdown.

SUMMARY OF THE INVENTION

Forming one aspect of the invention is a disposable for use with a structure having a surface that defines a basin for receiving liquid.

The disposable has a pair of surfaces spaced apart from one another by a tubular sidewall. One of the pair of surfaces is positioned, in use, against the basin-defining surface. In use, gas is introduced into the disposable pad and issues through the sidewall in the form of bubbles.

According to another aspect, the one of the pair of surfaces can be a self-adhesive surface adapted to hold the disposable against the basin-defining surface in use.

According to another aspect, the disposable can further comprise a release film overlying the self-adhesive surface; and the self-adhesive surface and the release film can be adapted such that the release film can be removed by hand to expose the self-adhesive surface for use.

According to another aspect, the disposable can define a central void and can further comprise a tube that extends through the sidewall and into the void.

According to another aspect, the disposable can comprise a foam pad having about 60 pores per inch, the pad defining the void and the sidewall.

According to another aspect, the pad can be about ¼ thick.

According to another aspect, the foam can have about the following properties: a porosity of 60 pores per inch; a density of 40 kg/m$^3$; tensile strength of 108 kpa; elongation of 184%; resilience of 45%; and tearing of strength 6.19 N/cm.

Forming yet another aspect of the invention is a system for use with a structure having a surface that defines a basin for receiving water, the system comprising: the disposables; and apparatus adapted to produce a flow of heated air and to couple to a disposable such that, in use, a flow of heated air issues through the sidewalls into the water contained in the basin to produce heated, roiling water in the basin.

Forming another aspect of the invention is apparatus for use with a liner and a drain, the apparatus comprising a body, a conduit, a discharge pump and a high-pressure pump. The body has an outlet and sized and shaped such that, in use of the liner: the liner occludes the outlet and defines a basin; and the outlet is positioned such that, if the liner were punctured, the basin would drain therethrough. The conduit extends from the outlet of the body. The discharge pump has an inlet to which the conduit extends and further has an outlet. The high-pressure pump has an inlet and an outlet, the inlet of the high-pressure pump being coupled to the conduit. The discharge pump and high-pressure pump have: a puncturing configuration wherein the high pressure pump draws fluid out of the conduit to cause the liner to rupture, to permit a drainage operation; and a draining configuration wherein the discharge pump ejects fluid to the drain in the drainage operation.

According to another aspect: the apparatus can further comprise an upstream valve having an inlet and an outlet, the inlet of the upstream valve being in fluid communication with the discharge pump; and, in the puncturing configuration, the upstream valve can be closed.

According to another aspect: the upstream valve is a backflow valve; the outlet of the high pressure pump is in fluid communication with the upstream valve; and, in the puncturing configuration, the upstream valve is held closed by the pressure exerted by the high pressure pump.

According to another aspect the apparatus can further comprise a downstream valve having an inlet and an outlet. The inlet is in fluid communication with the outlet of the upstream valve and the outlet of the high-pressure pump. The outlet is in fluid communication with the drain.

According to another aspect, the apparatus can further comprise a control system which causes the solenoid valve to open when the discharge pump is running.

According to another aspect, the control system can include a momentary switch to which the high pressure pump responds and which further triggers a timer switch to which the solenoid valve and discharge pump respond for a predetermined time.

According to another aspect, the predetermined time can be 2 minutes.

According to another aspect, the apparatus can further comprise a plug which: is adapted to be received in tight-fitting relation by the outlet of the body to secure the liner against movement to facilitate rupture of the liner; and has a screen to restrain debris in the basis from entering the conduit in the drainage operation.

Advantages, features and characteristics of the invention will become apparent upon a review of the following detailed description and the appended drawings, the latter being briefly described hereinafter.

DETAILED DESCRIPTION

Figure 1:
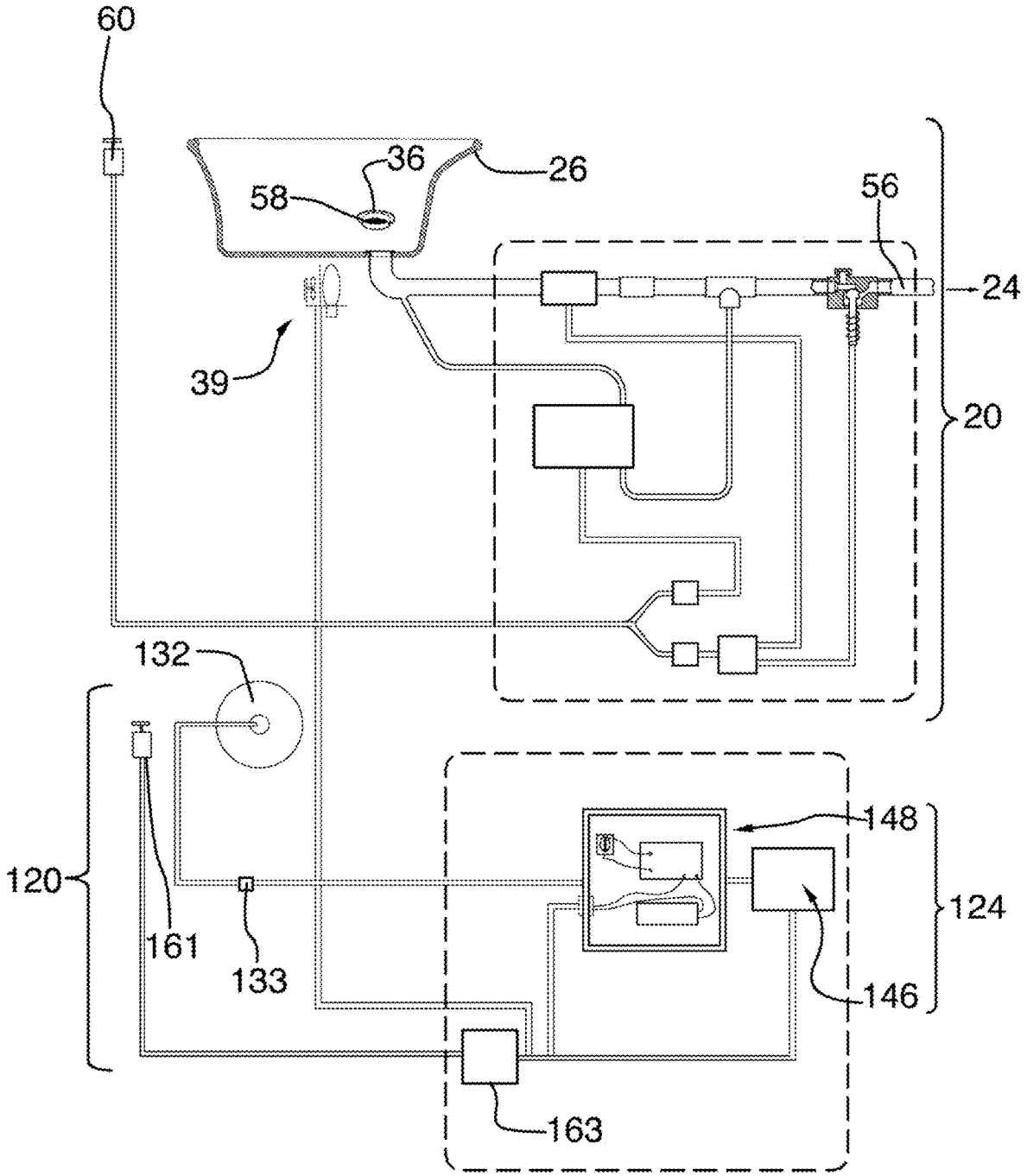
FIG. 1 is a partially schematic view of the workings of a foot spa system according to an exemplary embodiment of the invention.
Figure 2:
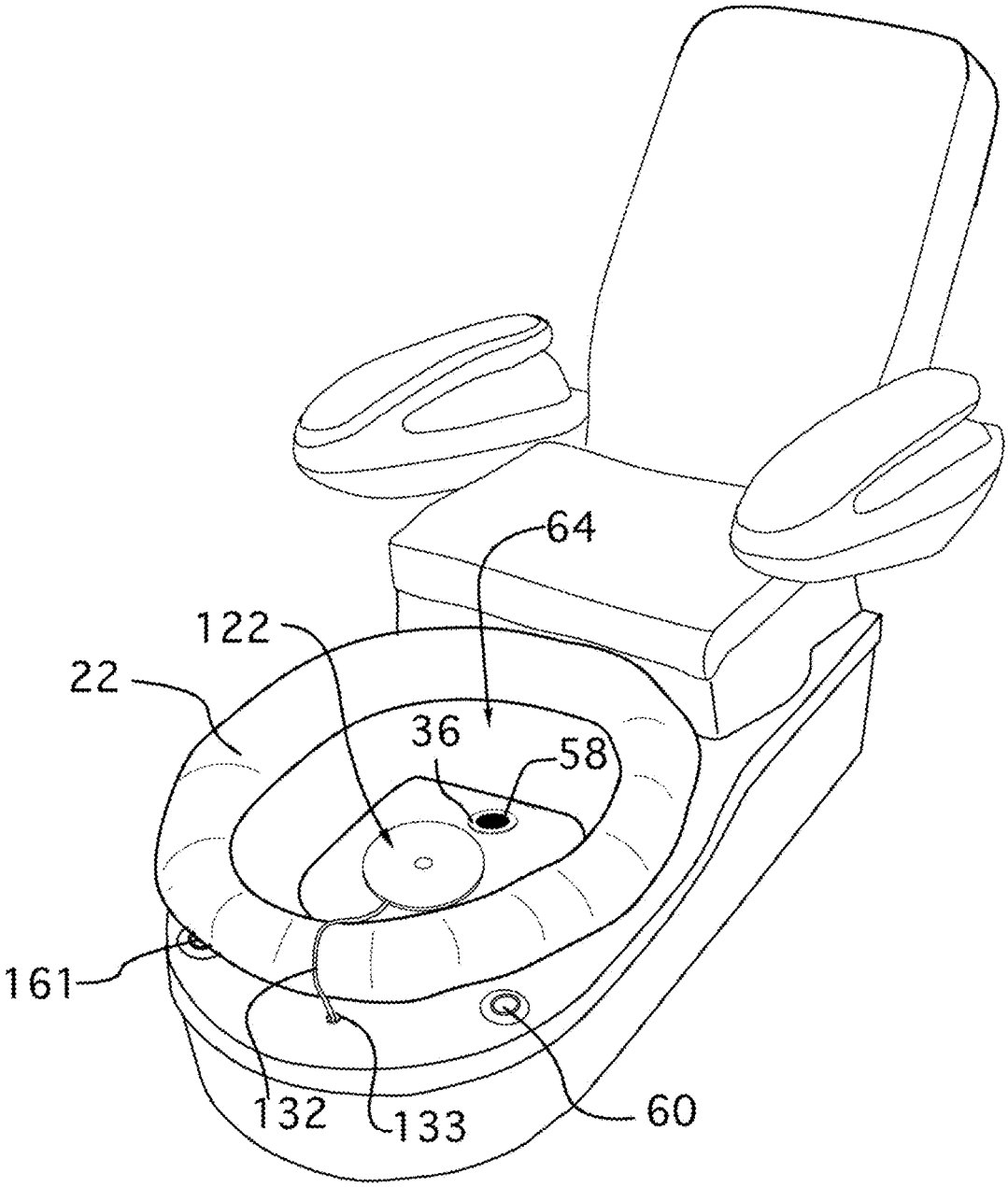
FIG. 2 is a view of the structure of FIG. 1 embodied in a foot spa and wherein a liner defines a basin ready to receive water.
Figure 3:
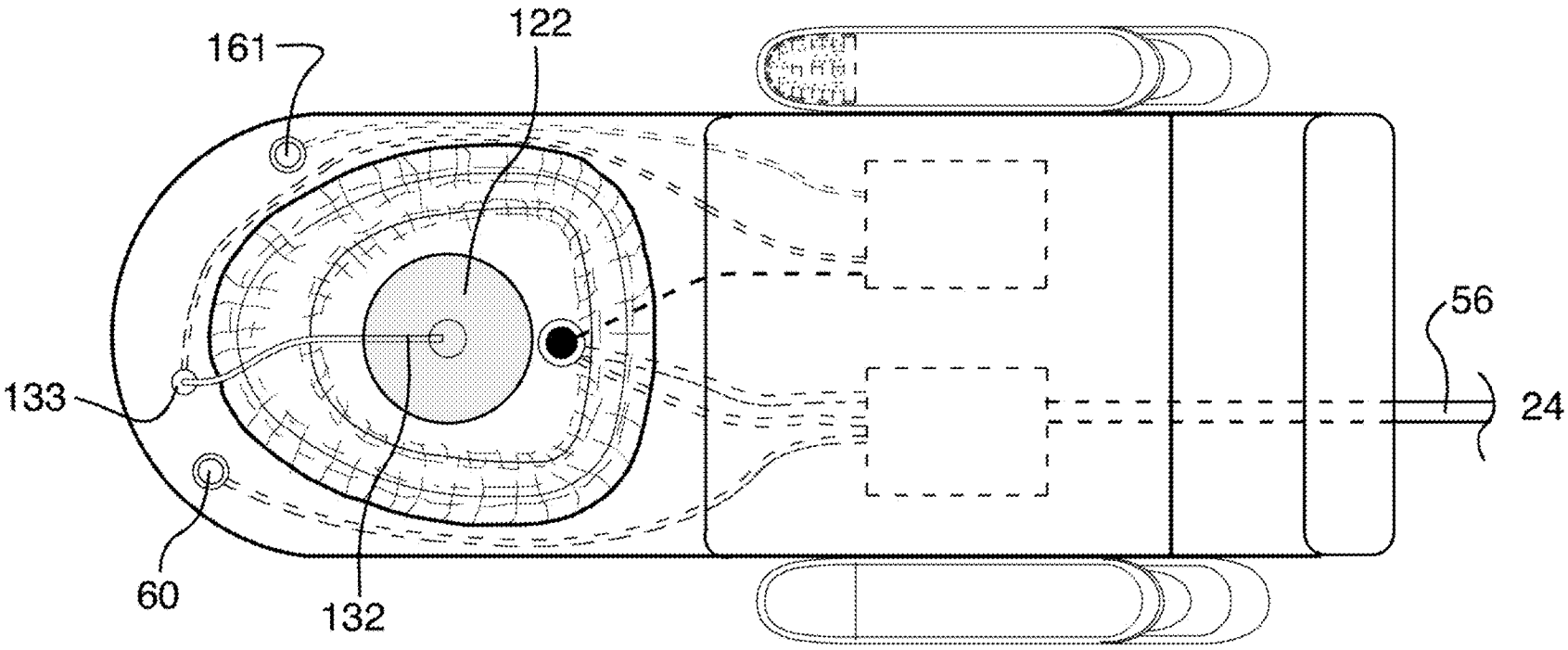
FIG. 3 is a top plan view of the structure of FIG. 2 with portions of the system shown in dotted line for better clarity.

The system of the present invention comprises a liner popper apparatus 20 and a bubble generation system 120, shown in schematic form in FIG. The liner popper apparatus 20 and bubble generation system 120 can be incorporated in a foot spa, as shown in FIG. 2 and FIG. 3 (only portions visible).

Liner Popper Apparatus

Figure 4:
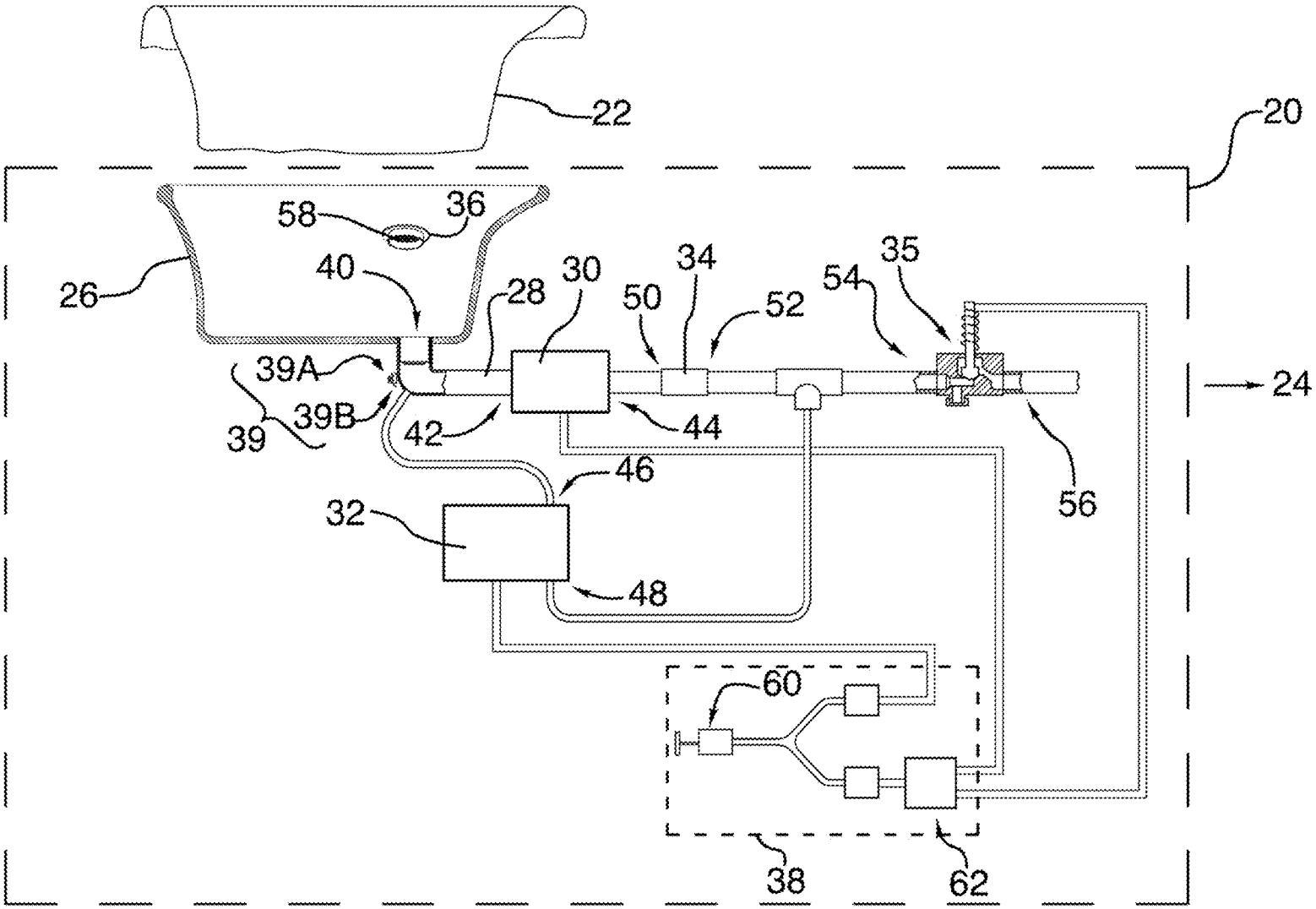
FIG. 4 is an enlarged view of a portion of FIG. 1 and further showing a liner adapted for use therewith.

The liner popper apparatus 20 of the present invention will be understood to be use with a liner 22 and drain 24 and the exemplary embodiment will be understood to comprise a body 26, a conduit 28, a discharge pump 30, a high-pressure pump 32, an upstream valve 34, a downstream valve 35, a plug 36, a control system 38 and a sanitizer 39, all as shown in FIG. 4

The body 26 is a bowl having a bottom outlet 40.

The conduit 28 extends from the outlet 40 of the body 26.

The discharge pump 30 has an inlet 42 to which the conduit 28 extends and further has an outlet 44.

The high-pressure pump 32 has an inlet 46 and an outlet 48, the inlet 46 of the high-pressure pump 32 being coupled to the conduit 28.

The upstream valve 34 is a backflow valve that has an inlet 50 and an outlet 52, the inlet 50 of the upstream valve 34 being in fluid communication with the outlet 44 of the discharge pump 30.

The downstream valve 35 is a solenoid valve and has an inlet 54 and an outlet 56, the inlet 54 being in fluid communication with the outlet 52 of the upstream valve 34 and with the outlet 48 of the high-pressure pump 32, the outlet 56 of the downstream valve 35 being in fluid communication with the drain 24.

The plug 36 has a screen 58 and is adapted to be received in tight-fitting relation by the outlet 40 of the body 26.

The control system 38 comprises a momentary pneumatic switch 60 which is directly coupled to the high pressure pump 32 and coupled via a timer 62 to the discharge pump 30 and the downstream valve 35.

The sanitizer 39 will be understood to comprise a UV light 39A and a cooling fan 39B.

Figure 5:
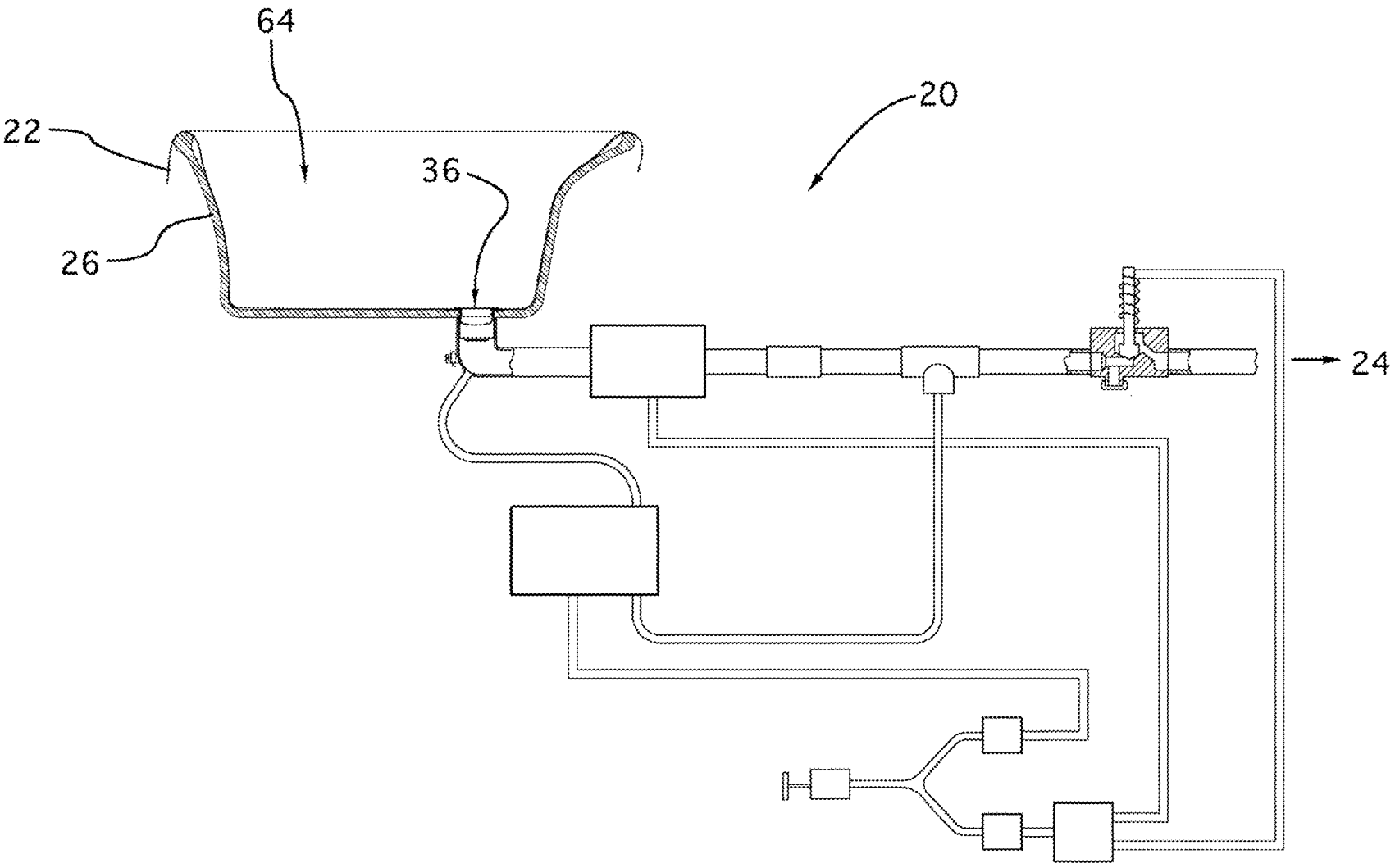
FIG. 5 is a view of the structure of FIG. 4 assembled for use.

The apparatus 20, liner 22 and drain 24 are shown assembled for use in FIG. 5. So assembled, the liner 22 will be seen to be draped over the bowl 26 to form a basin 64 for receiving water and the plug 36 will be seen to be disposed in the outlet, to secure the liner 22 against movement.

Figures 6A, 6B:
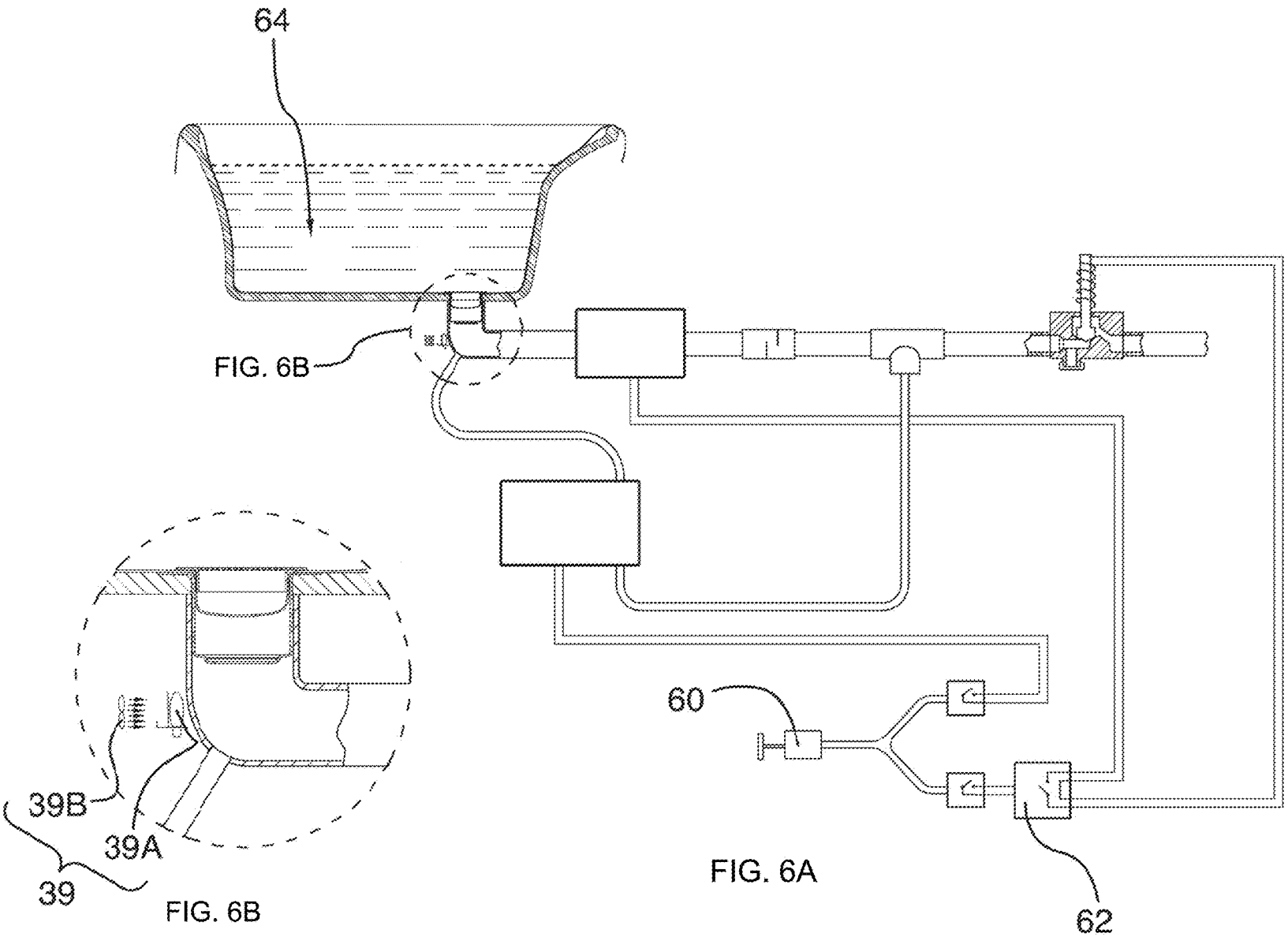
FIG. 6A is a view of the structure of FIG. 5, ready for use.
FIG. 6B is an enlarged view of encircled area 6B of FIG. 6A.

When the basin is in use, as shown in FIG. 6A, the basin 64 is filled with water.

Figure 7:
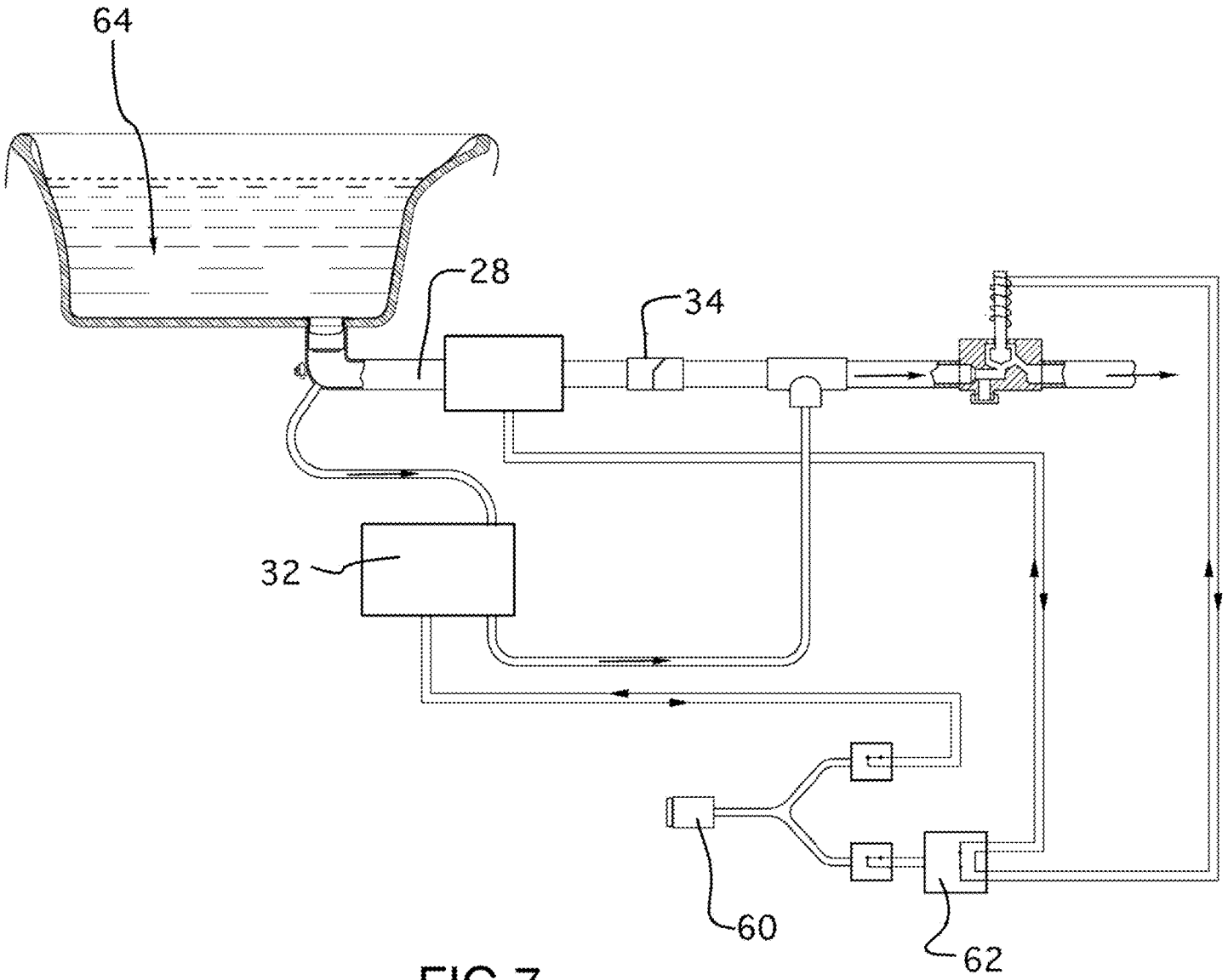
FIG. 7 is a view of the structure of FIG. 6A, with the switch depressed and in a puncturing configuration.
Figure 8:
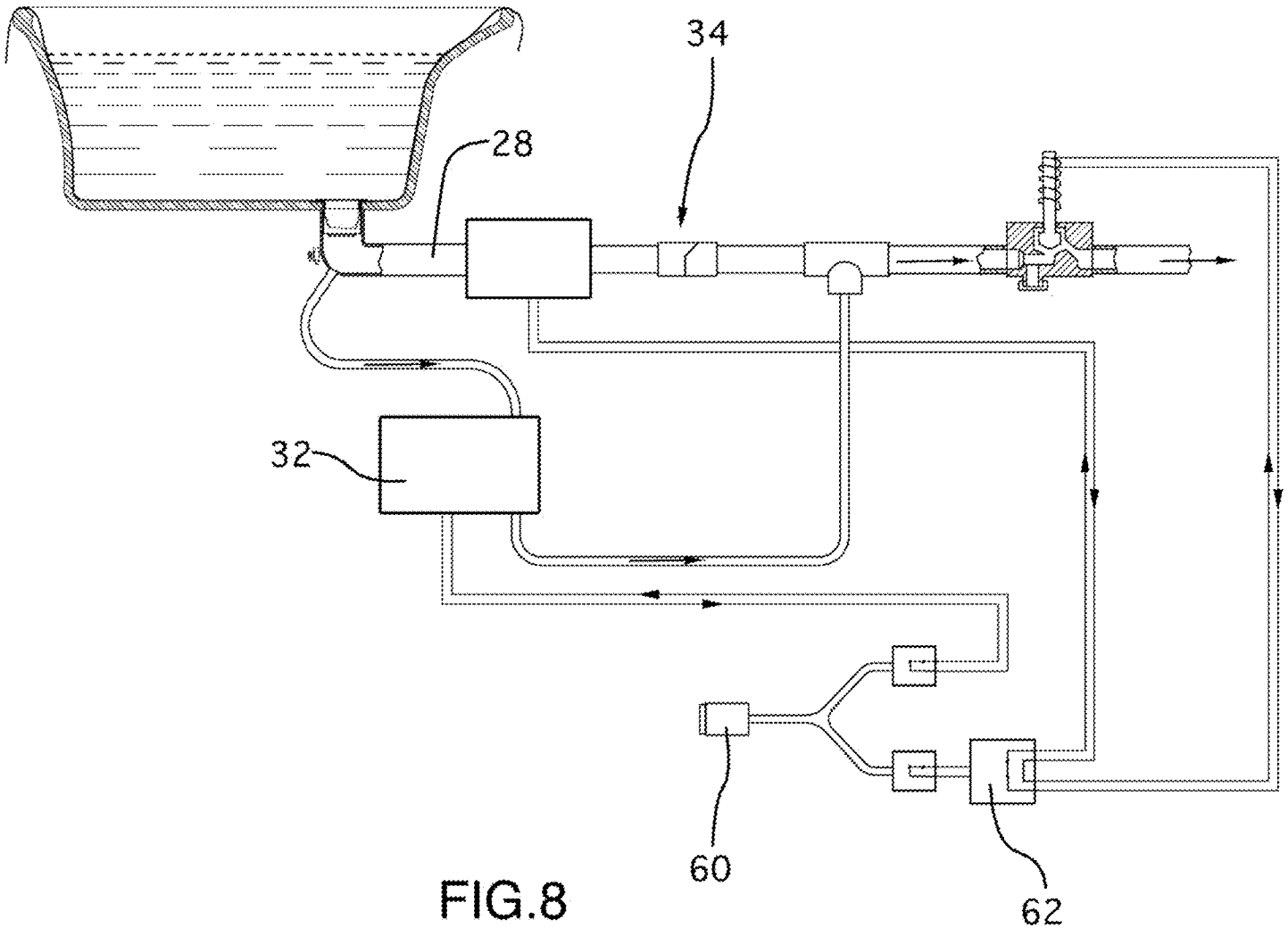
FIG. 8 is a view of the structure of FIG. 6A, with the membrane ruptured.

A puncturing configuration is entered upon depression of the switch 60, as shown in FIG. 7. Such depression of the switch 60 triggers the timer 62 and also, so long as the switch 60 remains depressed, actuates the high pressure pump 32, which draws fluid out of the conduit 28 and forces the backflow valve 34 closed, thereby creating vacuum conditions which ultimately rupture the membrane as shown in FIG. 8

Figure 9:
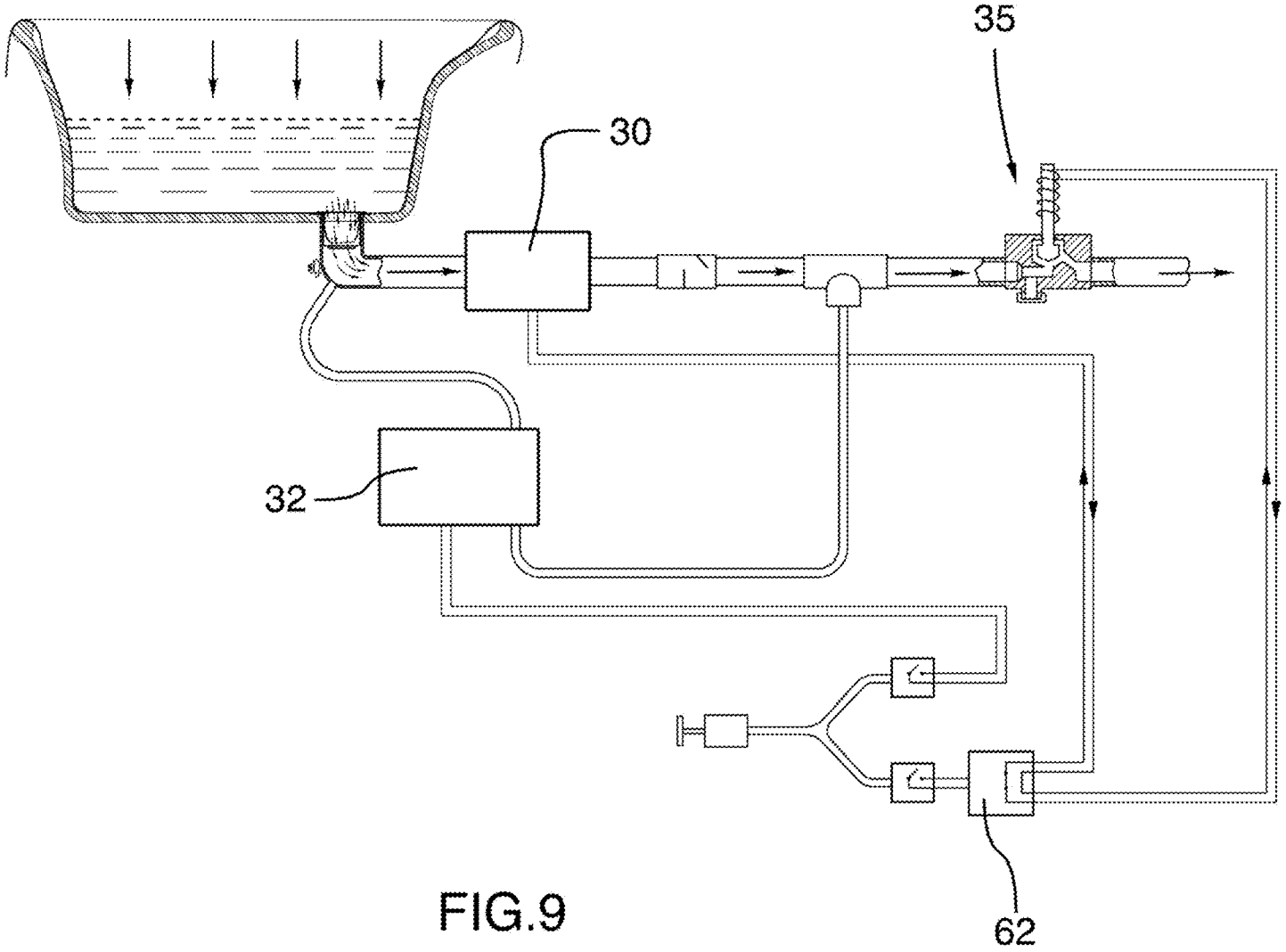
FIG. 9 is a view of the structure of FIG. 8, with the switch released.

Once the membrane has ruptured, the switch 60 can be released as shown in FIG. 9, which immediately ceases operation of the high pressure pump; 32 the discharge pump 30 continues pumping through the open solenoid valve 35 to the drain 24 for a period of time thereafter, since the timer 62 causes power to flow through the associated circuits for a predetermined period of time sufficient to drain the basin 64, namely, two minutes, in this embodiment.

Figure 10:
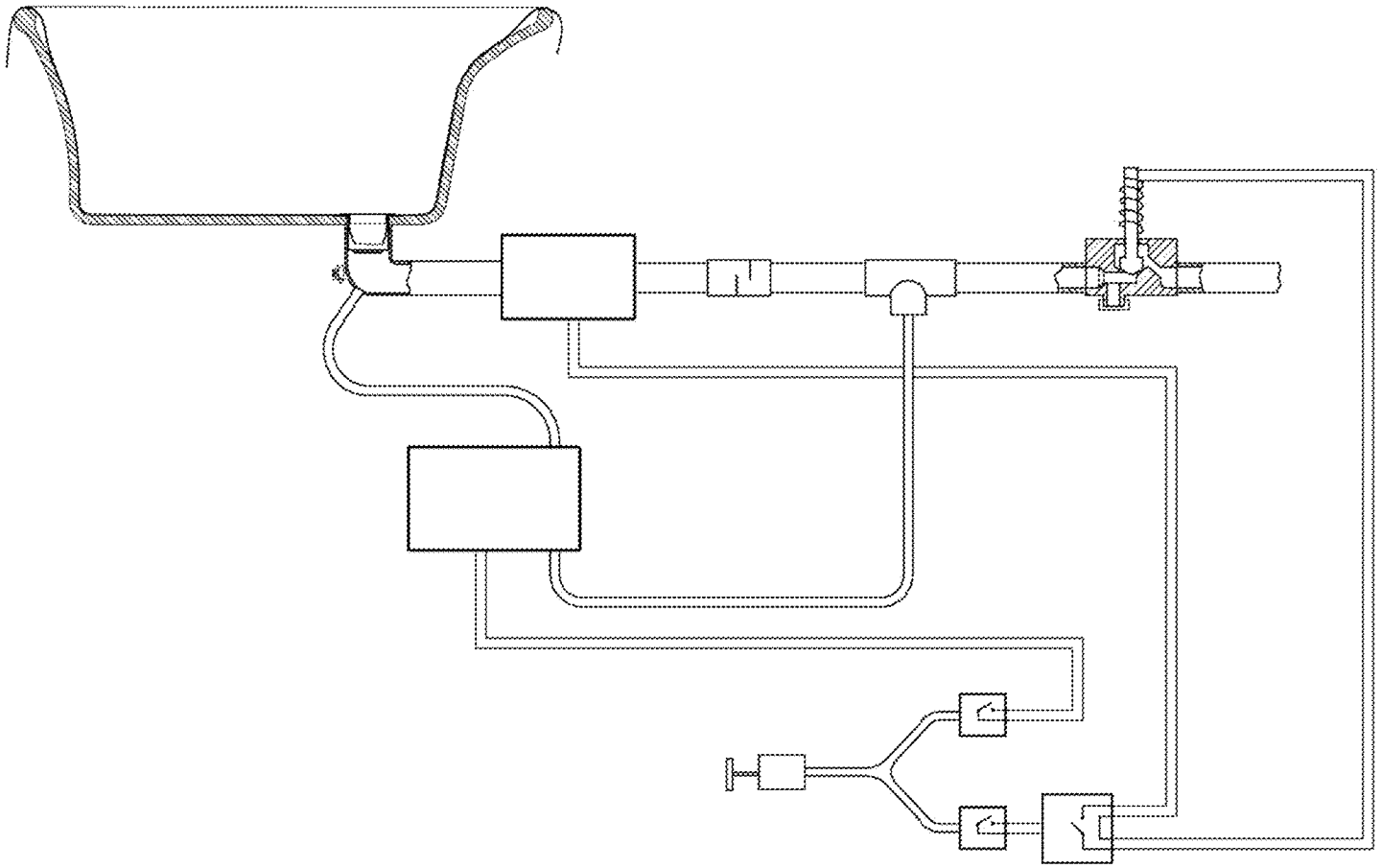
FIG. 10 is a view of the structure of FIG. 8, with the discharge pump rendered inoperable.

However, the solenoid valve 35 can be closed and the discharge pump 30 can be rendered inoperable, as indicated by FIG. 10, by a momentary depression of the switch 60 (momentary depression not shown); this functionality may be useful if, for example, basin 64 has been filled with too much water. It will be appreciated that this will allow for fluid communication between the interior of the basin 64 and the conduit 28; the sanitizer 39 is accordingly provided to ensure that any stray organic material that may have passed through filter 58 into conduit 28 is oxidized.

When it is desired to change liners such as, for example, at the end of spa treatment, to render the foot spa suitable for another client, the basin 64 can be drained by following the above steps, and thereafter, the plug 36 can be removed, to allow a new liner to be inserted. The screen 58 provided in the plug 36 ensures that large pieces of debris in the basin, such as skin and nails, do not enter the conduit.

Bubble Generation System

Figure 11:
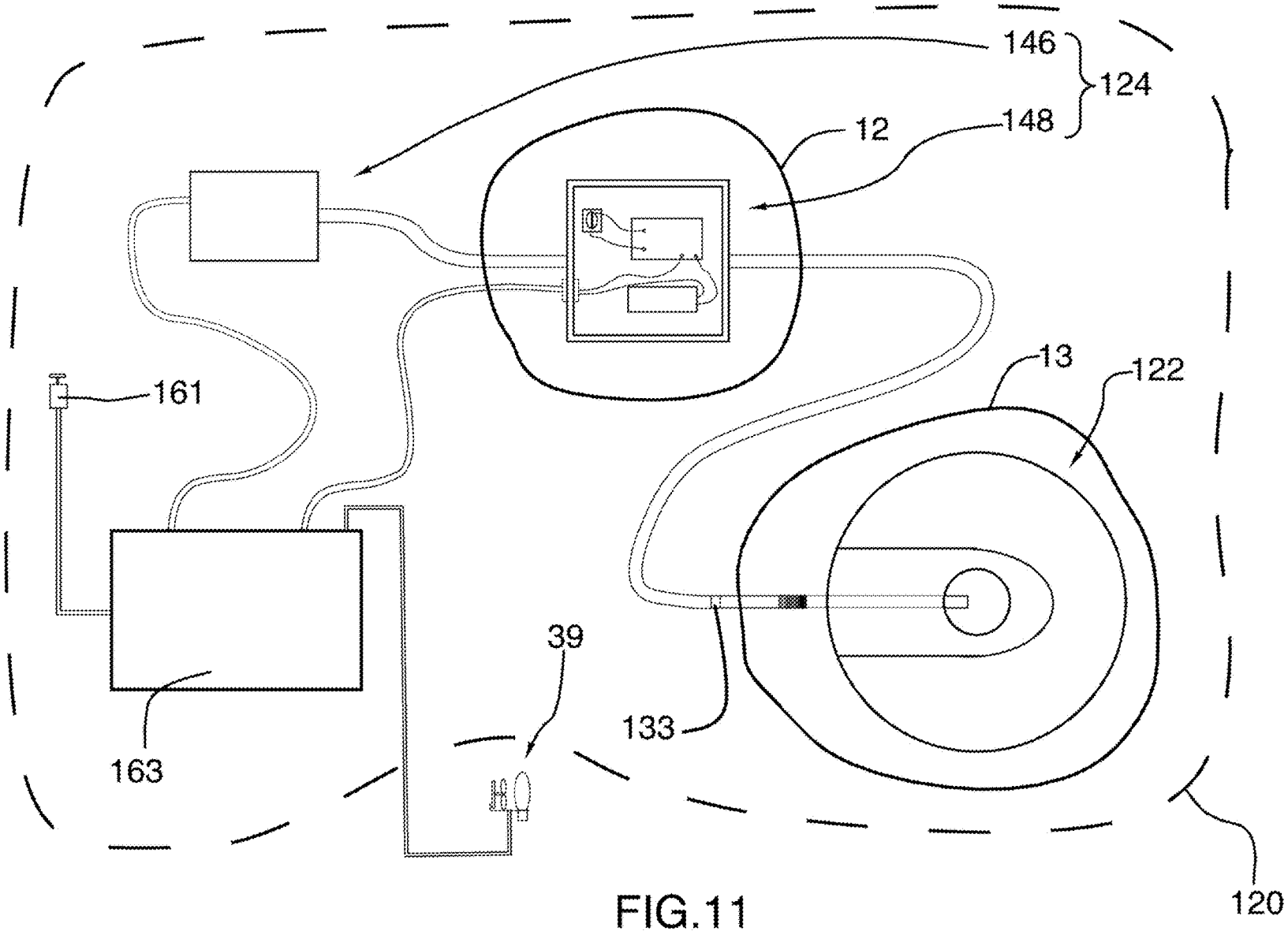
FIG. 11 is an enlarged view of a portion of the structure of FIG. 1.

The components of the bubble generation system 120 of the exemplary embodiment are shown in FIG. 11 and will be seen to include a disposable 122, a pump unit 124, a switch 161 and a controller 163. The sanitizer 39, previously described, is also shown in FIG. 11, for reasons which will be made evident in the paragraphs which follow.

Figure 13:
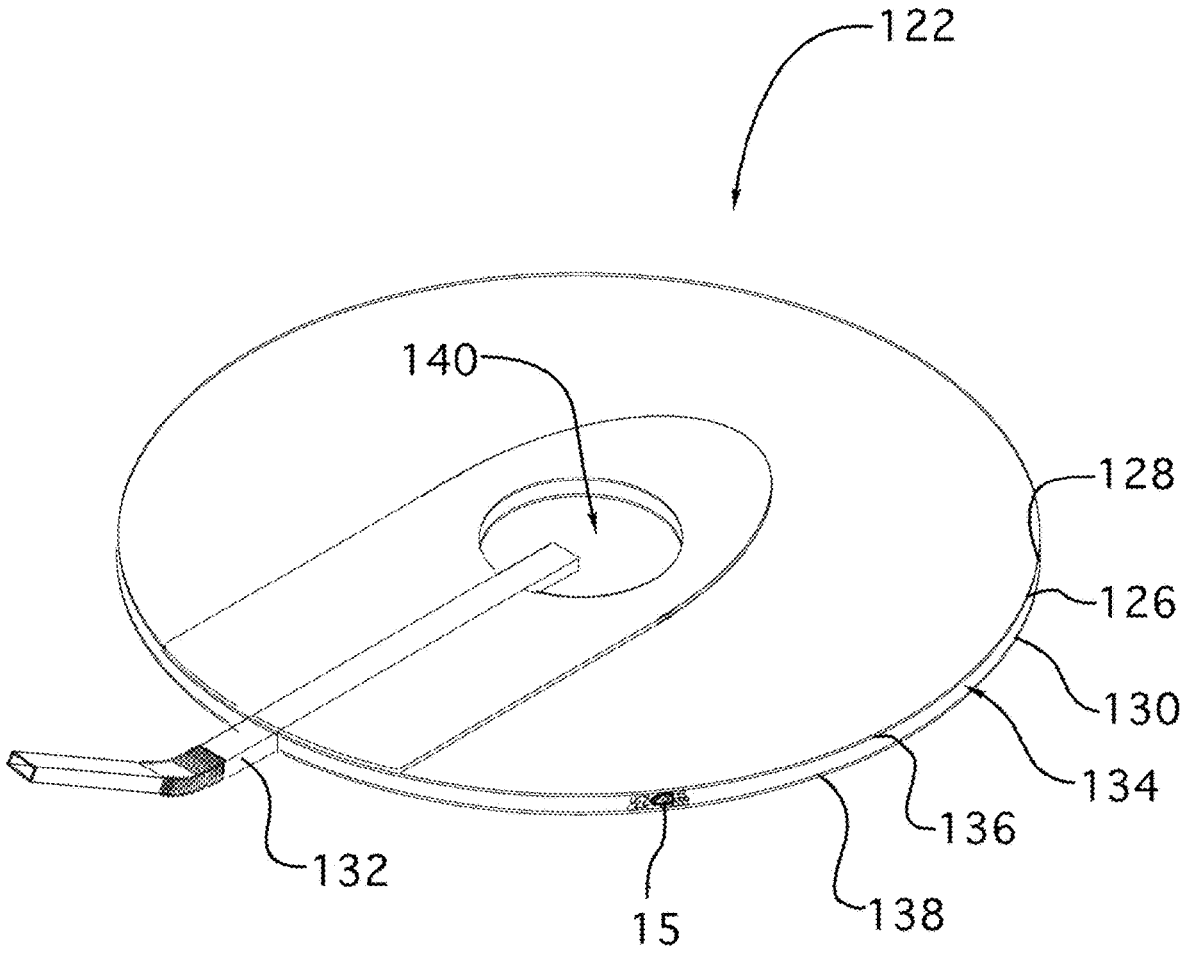
FIG. 13 is an enlarged view of the structure of encircled area 13 of FIG. 11.

The disposable 122 will be seen in FIG. 13 to comprise a pad 126, a seal 128, a release film 130 and a tube 132.

Figure 15:
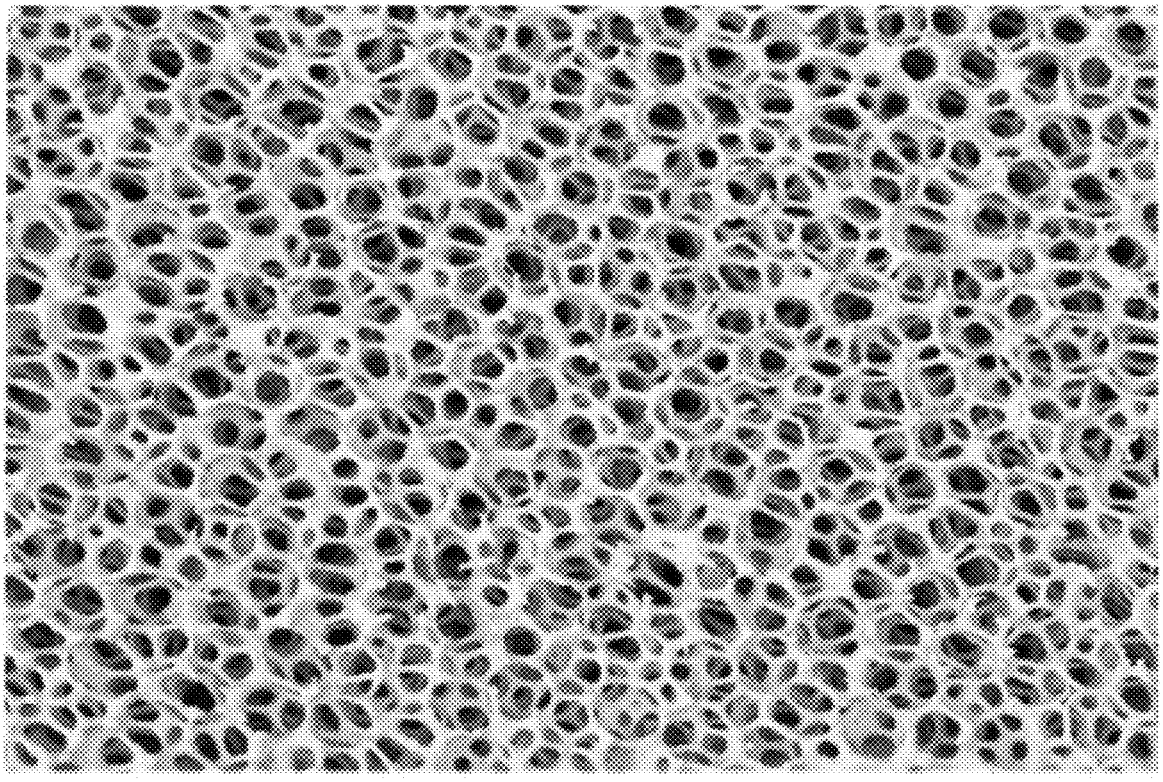
FIG. 15 is an enlarged view of encircled area 15 of FIG. 13

The pad 126: is about ¼" thick; has a tubular sidewall 134; has a pair of surfaces 136,138 spaced apart from one another by the tubular sidewall 134, one 138 of the pair of surfaces being a self-adhesive surface; is permeable to air flow; defines a central void 140; and is an open cell foam. The foam has about the following properties: a porosity of 60 pores per inch; a density of 40 kg/m$^3$; tensile strength of 108 kpa; elongation of 184%; resilience of 45%; and tearing of strength 6.19 N/cm. The open cell nature of the foam is evident from FIG. 15.

The seal 128 is a film layer that overlies the other 136 of the pair of surfaces and is at least substantially impermeable to air flow.

The release film 130 lies against the self-adhesive surface 138.

The tube 132 extends through the sidewall 134 and into the void 140.

Figure 14:
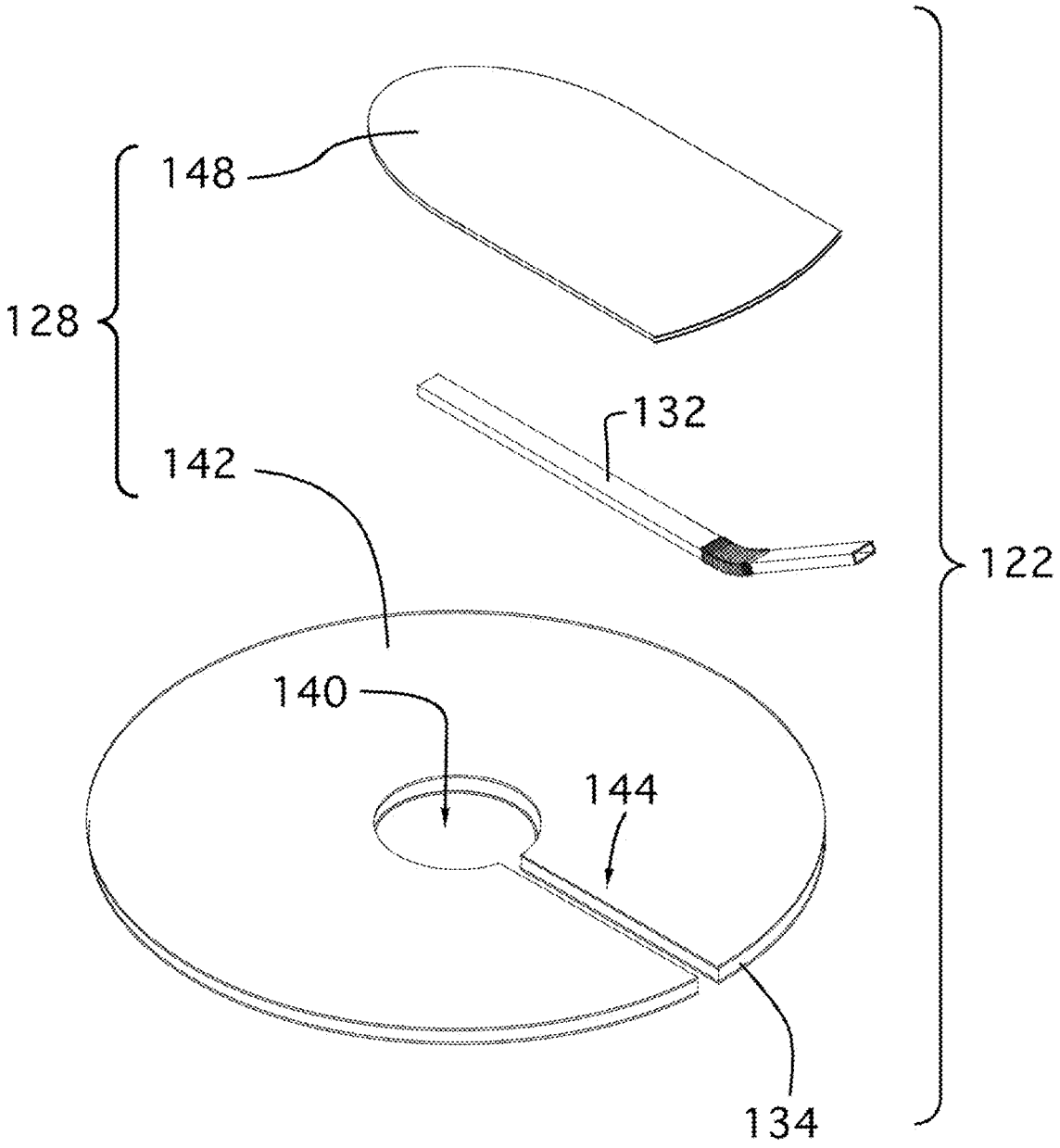
FIG. 14 is an exploded view of the structure of FIG. 13.

An exemplary manner of construction of the disposable is evidenced by FIG. 14.

Herein it will be seen that: a layer of open cell foam of the contemplated type, over which a film layer 142 is overlaid and the release layer is underlaid, is die stamped to define the sidewall 134, the central void 140 and a channel 144; the tube 32 is fitted into the channel 144; and a film patch 148 is welded to the film layer 142 to overlie the channel 144 and void 140, the patch 148 and layer 142 collectively defining seal 128

As shown in FIG. 11, the pump unit 124 is defined by a compressor 146 and a conditioner 148.

The compressor 146 is adapted to produce a flow of air and is not further detailed, as it is conventional.

Figure 12:
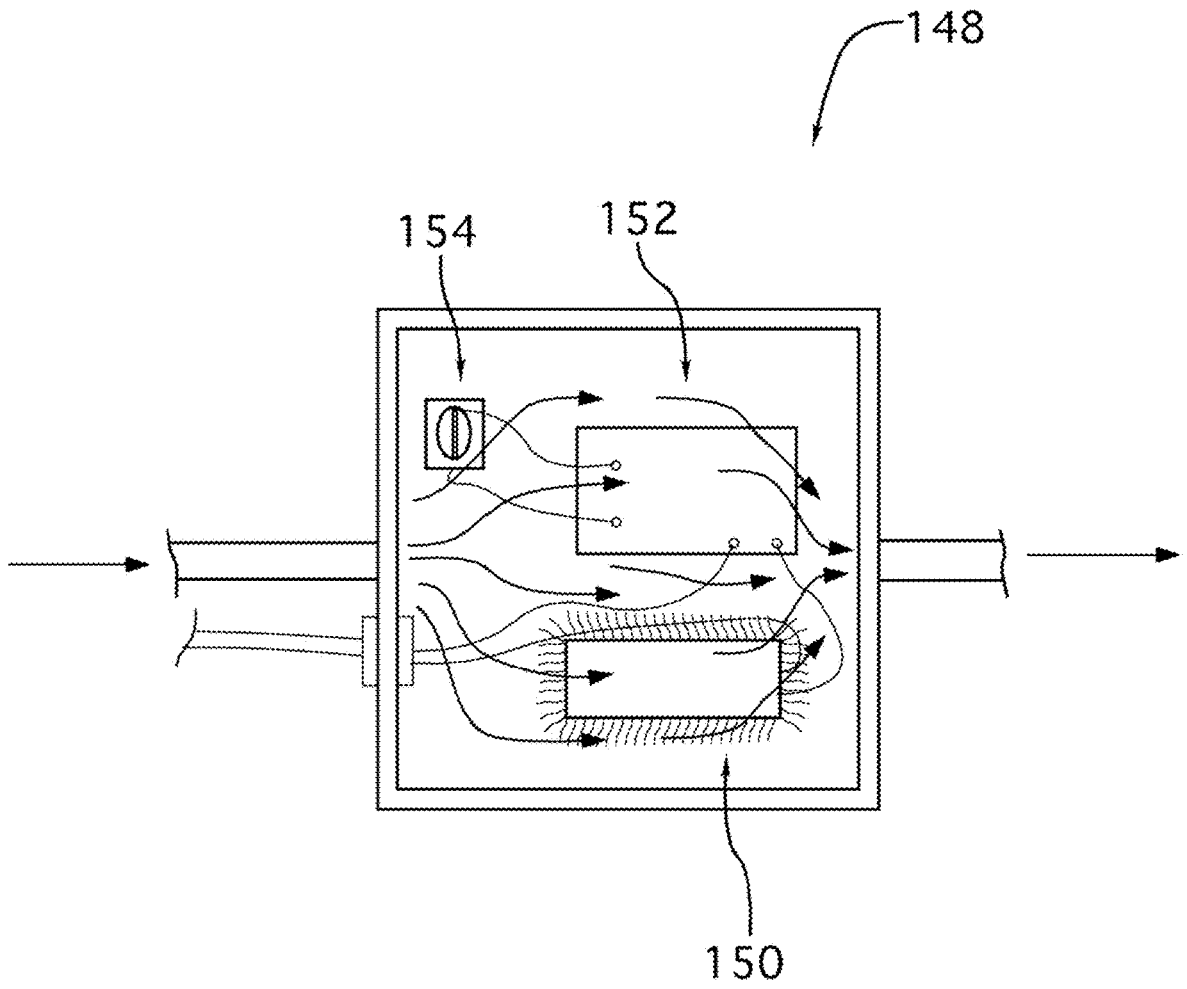
FIG. 12 is an enlarged view of the structure encircled area 12 of FIG. 11

The conditioner 148 is shown in FIG. 12 and will be seen to include a heater 150, a transformer 152 and an ozone generator 154. The heater 150 is a 400 W solid state diode heater, adapted to heat through passing air. The step up transformer 152 produces 10000 VAC which powers the ozone generator 154, to produce ozone.

The switch 161 is an air switch coupled to the controller 163 and enabled such that momentary depression of the switch 161 activates the controller and a further momentary depression of the switch 161 deactivates the controller 163.

The controller 163, when activated, provides electrical power to the compressor 146 conditioner 148 and the sanitizer 39.

Figure 16:
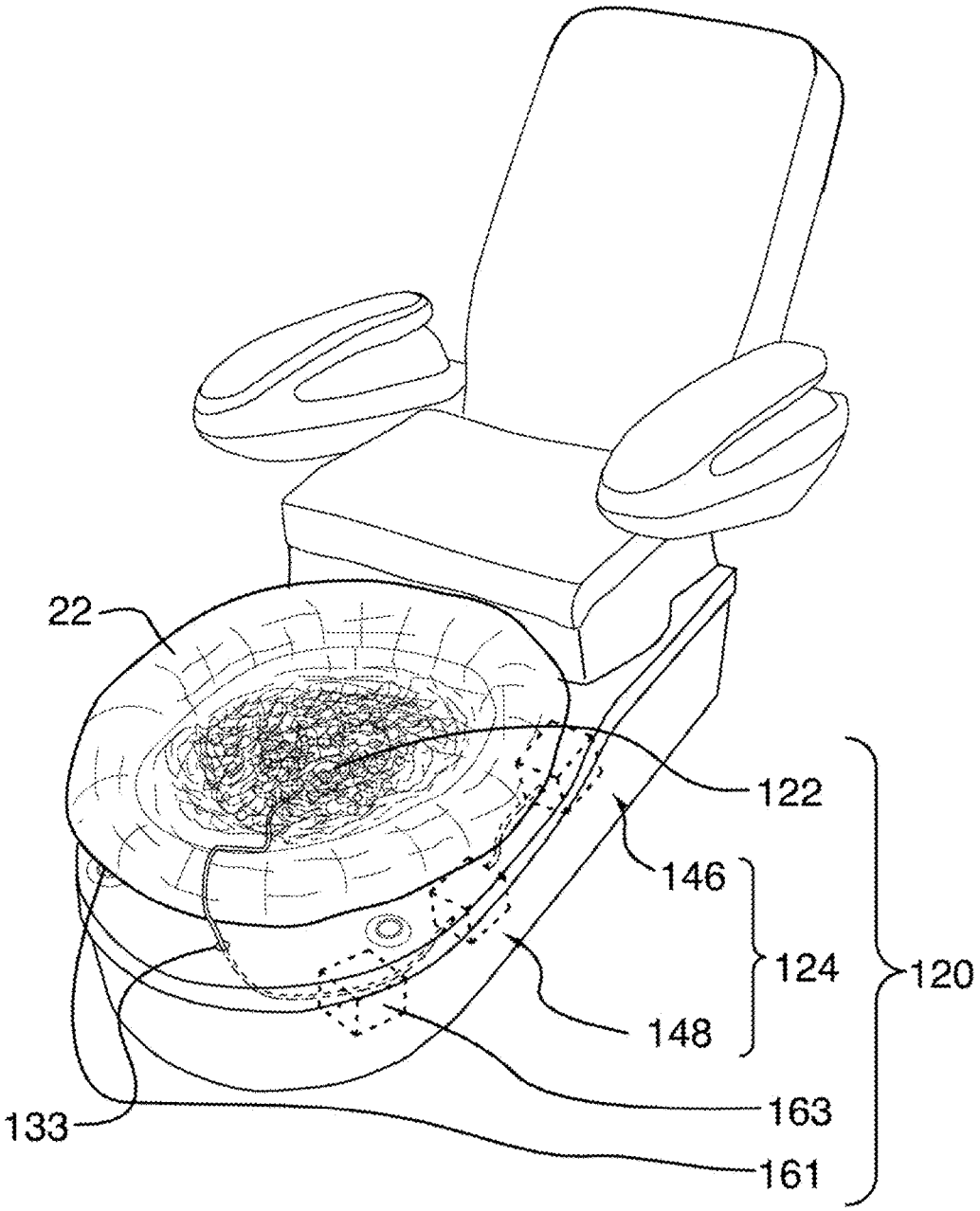
FIG. 16 is a view of the structure of FIG. 11 in use.
Figure 17:
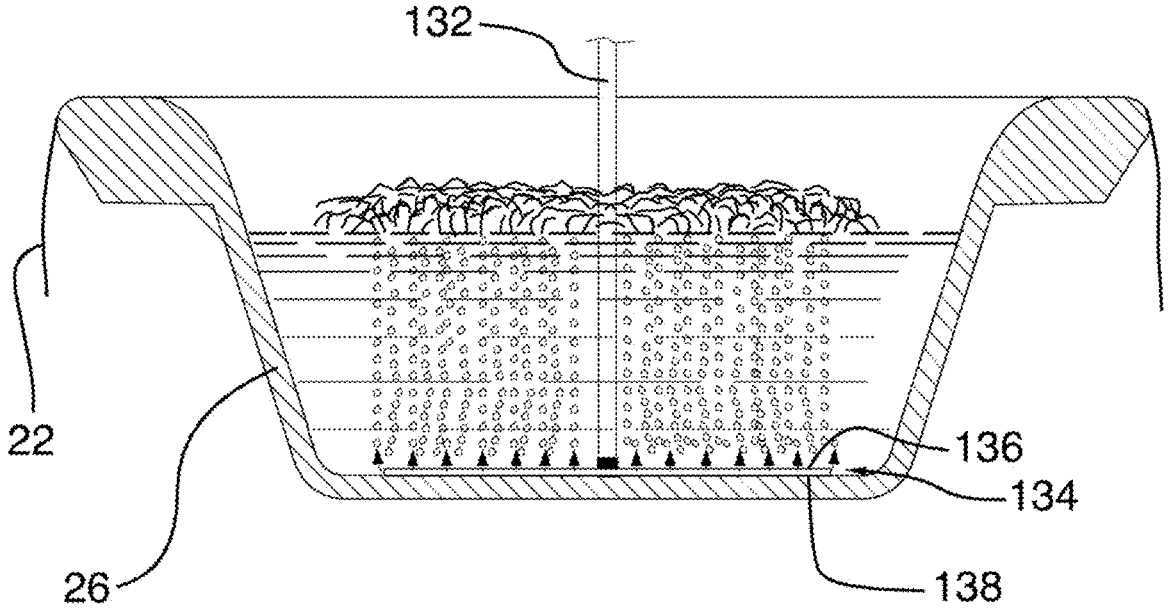
FIG. 17 is a side sectional view of a portion of FIG. 16.

The exemplary system 120 is adapted for use with pedicure spa vessels and is shown in use with a pedicure spa and a liner 22 in FIG. 16.

For use: the release layer 130 is removed from one of the disposables 122, thereby exposing the self-adhesive surface 138, which, in turn, is secured to the liner 22; pump unit 124 is coupled to the tube 132; water is placed in the basin 64; the pump unit 124 is activated, thereby to cause heated, ozonated air to: travel through tube 132 into the void 140; traverse the foam; issue through the sidewall 134 in the form of bubbles, thereby producing heated, disinfected roiling water in the basin 64.

Persons of ordinary skill will readily appreciate numerous advantages associated with the system including, inter alia: the disposable 122 can be removed and replaced regularly, with commensurate advantages in terms of hygiene; the disposable 122 is relatively inexpensive to construct; and the pump unit 124 is relatively inexpensive to construct and operate, and relatively durable. In the exemplary embodiment, the tube 132 that extends from the pad terminates in a quick connect 133 by which the disposable is coupled to the conditioner 148; this enables the disposable 122 and liner 26 to be quickly removed and replaced between salon clients.

Whereas a specific embodiment is shown, it will be evident that variations are possible.

For example, whereas a self-adhesive layer is shown, this is not strictly necessary as a second impermeable layer could be provided in the place of the self-adhesive layer and the disposable could be secured, for example, by hook and loop fasteners.

Figure 18:
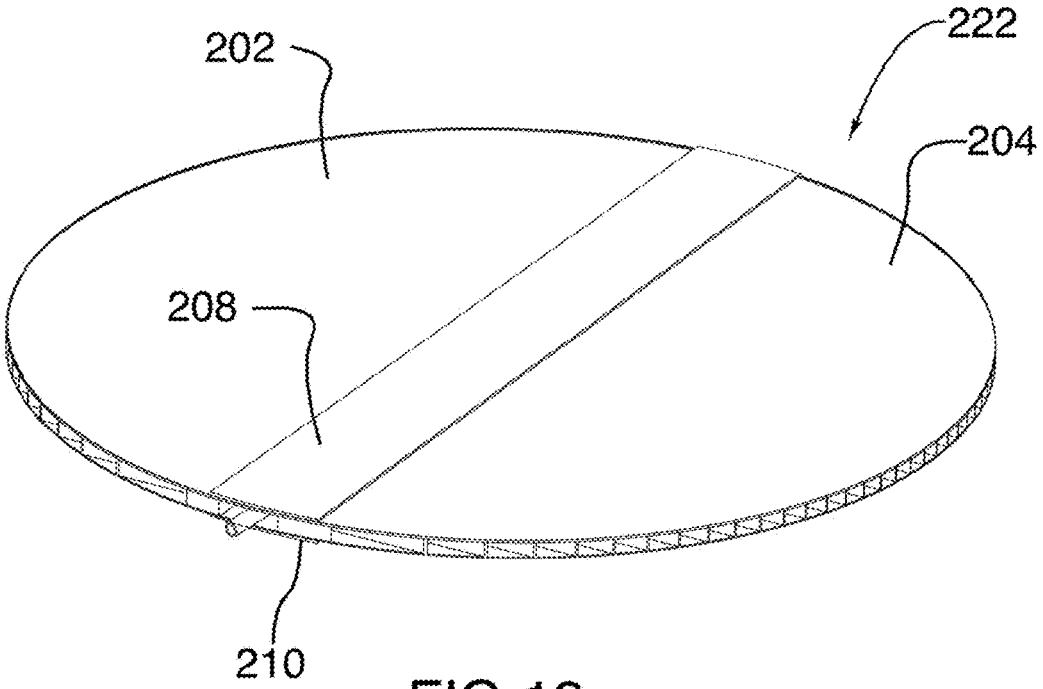
FIG. 18 is a view of an alternative embodiment of the structure of FIG. 13.
Figure 19:
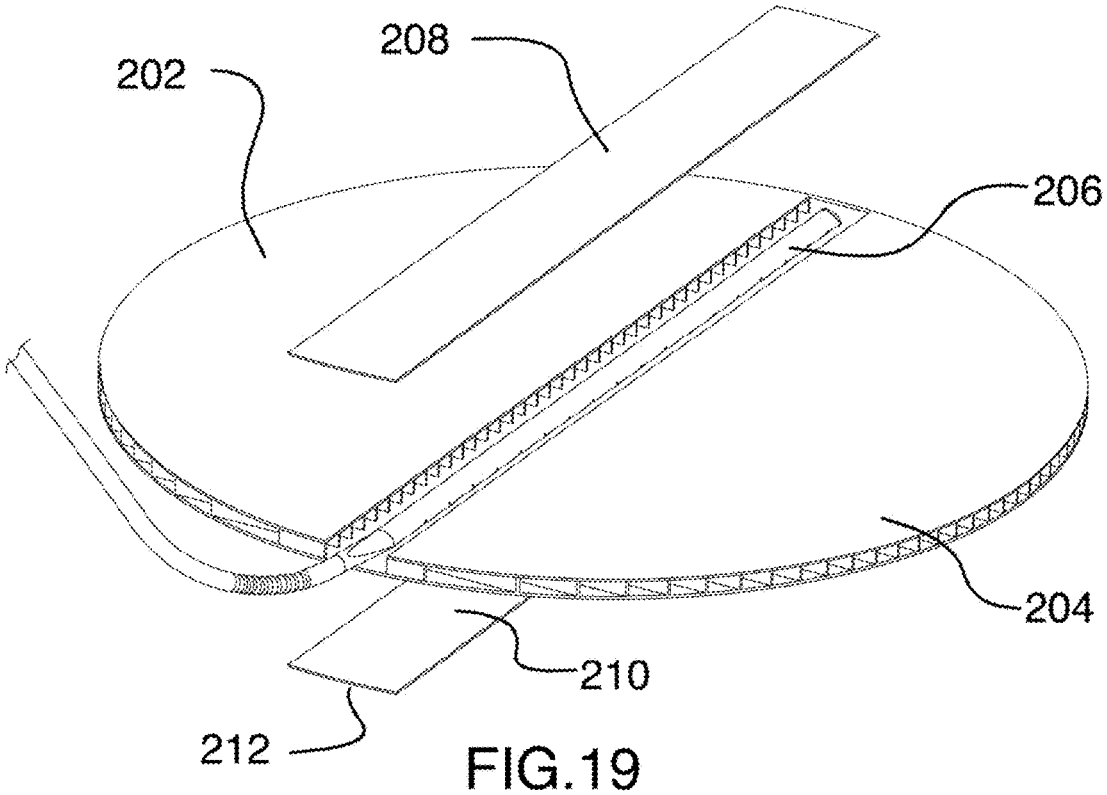
FIG. 19 is an exploded view of the structure of FIG. 18.

As well, whereas in the exemplary embodiment illustrated, an open cell foam is used for the disposable, other forms of construction are possible. For example, a disposable 222 is shown in FIG. 18 which is composed of a pair of semi-circular panels 202, 204, die cut from corrugated plastic board, disposed in flanking relation to a perforated tube 206 and sealed to one another by lengths of tape 208,210, one of the lengths 210 being doubled-sided and covered with a release strip 212, to secure the disposable 222 to the liner 22 in use.

Further, whereas in the exemplary embodiment illustrated, the sanitizer 39 is activated whenever bubbles are being generated, this is not required and other triggering/powering mechanism could be employed.

Accordingly, the invention should be understood to be limited only by the accompanying claims, purposively construed.

The invention claimed is:

1. Apparatus for use with a liner and a drain, the apparatus comprising: a body having an outlet, the body being sized and shaped such that, in use of the liner: the liner occludes the outlet and defines a basin; and the outlet is positioned such that, if the liner were punctured, the basin would drain therethrough;

a conduit extending from the outlet of the body;

a discharge pump having an inlet to which the conduit extends and further having an outlet; and a second pump having an inlet and an outlet, the inlet of the second pump being coupled to the conduit, the discharge pump and second pump having:

a puncturing configuration wherein the high pressure second pump draws fluid out of the conduit to cause the liner to rupture, to permit a drainage operation; and a draining configuration wherein the discharge pump ejects fluid to the drain in the drainage operation.

2. Apparatus according to claim 1, further comprising an upstream valve having an inlet and an outlet, the inlet of the upstream valve being in fluid communication with the discharge pump; and wherein, in the puncturing configuration, the upstream valve is closed.

3. Apparatus according to claim 1, wherein the upstream valve is a backflow valve, the outlet of the second pump is in fluid communication with the upstream valve and, in the puncturing configuration, the upstream valve is configured to be closed.

4. Apparatus according to claim 1, further comprising a downstream valve having an inlet which is in fluid communication with the outlet of the upstream valve and the outlet of the second pump and an outlet which is in fluid communication with the drain.

5. Apparatus according to claim 4, further comprising a control system which causes a solenoid valve to open when the discharge pump is running.

6. Apparatus according to claim 5, wherein the control system includes a momentary switch to which the second pump responds and which further triggers a timer switch to which the solenoid valve and discharge pump respond for a predetermined time.

7. Apparatus according to claim 6, wherein the predetermined time is 2 minutes.

8. Apparatus according to claim 1, further comprising a plug which is adapted to be received in tight-fitting relation by the outlet of the basin to secure the liner against movement to facilitate rupture of the liner and which has a screen to restrain debris in the basis from entering the conduit in the drainage operation.

9. A disposable for use with a surface that defines a basin for receiving liquid in an apparatus of claim 1, the disposable comprising:

a pad of having a pair of surfaces spaced apart from one another by a tubular sidewall, one of the pair of surface being positioned, in use, against the surface; and wherein, in use, gas is introduced into the pad and issues through the sidewall in the form of bubbles.

10. The disposable according to claim 9, wherein the one of the pair of surfaces is a self-adhesive surface adapted to hold the disposable against the basin-defining surface in use.

11. The disposable according to claim 10, further comprising a release film overlying the self-adhesive surface; and wherein the self-adhesive surface and the release film are adapted such that the release film can be removed by hand to expose the self-adhesive surface for use.

12. The disposable according to claim 9, wherein the disposable defines a central void; and further comprising a tube that extends into the void.

13. The disposable according to claim 9, wherein the disposable comprises a foam pad, the foam having about 60 pores per inch.

14. The disposable according to claim 13, wherein the pad is about ¼" thick.

15. The disposable according to claim 14, wherein the foam has properties of about:

| | |
|---|---|
| density | 40 kg/m3 |
| tensile strength | 108 kpa |
| elongation | 184% |
| resilience | 45% |
| tearing strength | 6.19 N/cm. |

16. A system for use with a structure having a surface that defines a basin for receiving water, the system comprising:

a plurality of disposables, each of said plurality of disposables comprising: a pad of having a pair of surfaces spaced apart from one another by a tubular sidewall, one of the pair of surface being positioned, in use, against the surface; and wherein, in use, gas is introduced into the pad and issues through the sidewall in the form of bubbles; and apparatus according to claim 1 adapted to produce a flow of heated air and to couple to a disposable such that, in use, a flow of heated air issues through the sidewalls into the water contained in the bowl to produce heated, roiling water in the basin.

* * * * *